US009689642B2

(12) United States Patent
Axelsson

(10) Patent No.: US 9,689,642 B2
(45) Date of Patent: Jun. 27, 2017

(54) GAS POWERED GUN

(71) Applicant: FX AIRGUNS AB, Mariestad (SE)

(72) Inventor: Fredrik Axelsson, Mariestad (SE)

(73) Assignee: FX AIRGUNS AB, Mariestad (SE)

( * ) Notice: Subject to any disclaimer, the term of this patent is extended or adjusted under 35 U.S.C. 154(b) by 0 days.

(21) Appl. No.: 15/057,274

(22) Filed: Mar. 1, 2016

(65) Prior Publication Data

US 2016/0258710 A1 Sep. 8, 2016

(30) Foreign Application Priority Data

Mar. 2, 2015 (EP) ..... 15157143

(51) Int. Cl.
*F41B 11/72* (2013.01)
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41B 11/72; F41B 11/721; F41B 11/722; F41B 11/723; F41B 11/724
USPC ..... 124/76
See application file for complete search history.

(56) References Cited

U.S. PATENT DOCUMENTS 4,936,282 A * 6/1990 Dobbins ..... F41B 11/723 124/73
5,257,614 A * 11/1993 Sullivan ..... F41B 11/00 124/73
7,770,571 B2 * 8/2010 Tippmann, Jr. ..... F41B 11/00 124/73
2006/0278205 A1 * 12/2006 Axelsson ..... F41B 11/723 124/72
2016/0047620 A1 * 2/2016 Tseng ..... F41B 11/721 124/65

FOREIGN PATENT DOCUMENTS

EP 1729084 A1 12/2006
GB 2458349 A 9/2009

OTHER PUBLICATIONS

European Search Report issued in European Application No. 15157143.7, dated Feb. 27, 2015, which the instant application claims priority to; 5 pgs.

* cited by examiner

*Primary Examiner* — Joshua Freeman
(74) *Attorney, Agent, or Firm* — Harness, Dickey & Pierce, P.L.C.

(57) ABSTRACT

The invention relates to a gas powered gun for discharge of projectiles, comprising an open-close valve arranged in a rear end of a pressure chamber, and arranged, in its open state, to allow passage of gas from the pressure chamber into a barrel, to thereby discharge a projectile. The open-close valve comprises a valve seat and a valve head provided in one end of an elongated extension member. A hammer is arranged to cooperate with a hammer cooperating member provided at a second end of the elongated extension member. The hammer is arranged between the valve head and the hammer cooperating member, so that, when the hammer is moved in the firing direction into contact with the hammer cooperating member, the hammer cooperating member pulls the valve head out of contact with the valve seat, thereby bringing the open-close valve to its open state.

9 Claims, 4 Drawing Sheets

GAS POWERED GUN

CROSS-REFERENCE TO RELATED APPLICATION

This application claims the benefit of, and priority to, European Patent Application No. 15157143.7 filed Mar. 2, 2015. The entire disclosure of the above application is incorporated herein by reference.

FIELD OF THE INVENTION

The present disclosure relates to a gas powered gun for discharge of projectiles. The gas powered gun comprises a barrel adapted to receive a projectile, a pressure chamber adapted to communicate with a compressed gas source, and an open-close valve arranged in a rear end of said pressure chamber, and arranged, in its open state, to allow passage of gas from said pressure chamber into said barrel, to thereby discharge said projectile.

BACKGROUND OF THE INVENTION

Airguns of the above type operated by compressed gas from a cartridge which is connected to the airgun are well known. The length of the barrel through which the projectile ejects is usually of standard size, and hence due to the design of the airguns, the air guns are usually rather long.

In some airgun types it is preferable to have the trigger in front of the opening of the barrel where the projectile is inserted, however a mechanical linkage between the trigger and the hammer is necessary in order to fire the gun.

Hence, there is a need for an alternative solution.

GENERAL DISCLOSURE OF THE INVENTION

The inventor has realized that by having a different arrangement of the open-close valve, the hammer and the pressure chamber a simpler design and a more compact airgun can be achieved. The present disclosure relates to a gas powered gun for discharge of projectiles, comprising:

a barrel adapted to receive a projectile, a pressure chamber adapted to communicate with a compressed gas source, an open-close valve arranged in a rear end of the pressure chamber, and arranged, in its open state, to allow passage of gas from the pressure chamber into the barrel, to thereby discharge the projectile, the open-close valve comprising a valve seat and a valve head adapted to sealingly abut the valve seat to close the valve, the valve head being provided in one end of an elongated extension member, and a hammer arranged to cooperate with a hammer cooperating member provided at a second end of the elongated extension member, wherein the elongated extension member extends in a firing direction of the gun through the pressure chamber, and the hammer is arranged between the valve head and the hammer cooperating member, so that, when the hammer is moved in the firing direction into contact with the hammer cooperating member, the hammer cooperating member pulls the valve head out of contact with the valve seat, thereby bringing the open-close valve to its open state.

It is a desirable to have a barrel which is as long as possible but at the same time the gun should be short and compact so that it can be handled more easily. By arranging the hammer between the valve head and the hammer cooperating member, which both are arranged at opposite ends of the elongated extension member the open-close valve at the rear end of the pressure chamber can be arranged close to the end of the barrel where gas passes into the barrel in order to discharge the projectile and the hammer may be arranged close to the trigger. The elongated extension member connects the trigger with the open-close valve in an easy way.

According to at least one exemplary embodiment the extension member is slidingly arranged through a central opening of the hammer.

This way the hammer is arranged around the elongated extension member and the force on the hammer may evenly distributed on the hammer cooperating member.

According to at least one exemplary embodiment the gas powered gun further comprises a spring abutment, and a spring arranged between the spring abutment and the hammer, for spring loading the hammer, wherein the extension member is slidingly arranged through a central opening of the spring abutment and through the spring.

According to at least one exemplary embodiment the hammer is arranged between the pressure chamber and the hammer cooperating member. This way the hammer is arranged outside the pressure chamber, and it is easier to arrange a hammer loading mechanism.

According to at least one exemplary embodiment the hammer cooperating member is removably attached to the elongated extension member. This way the hammer cooperating member is a separated part from the elongated extension member, which may simplify the assembly of the gun.

According to at least one exemplary embodiment the hammer co-operating portion comprises a threaded portion which is mutually matching with a threaded portion on the elongated extension member. By having mutually matching threaded portions the elongated extension member may be screwed into the hammer cooperating member or the other way around.

According to at least one exemplary embodiment the valve head and the extension member are connected by means of a threaded sleeve, located inside the pressure chamber. This way the hammer head is a separated part from the elongated extension member, which may simplify the assembly of the gun.

According to at least one exemplary embodiment an end portion of the hammer cooperating member is guided by a support. This support holds and guides the hammer cooperating member and the elongated extension member in a correct position.

According to at least one exemplary embodiment the support comprises a spring abutment, a spring being arranged between the spring abutment and the hammer cooperating member for pushing the valve head into a closed stated after being opened. The spring helps to close the valve after being opened.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

Other objectives, features and advantages of the present invention will appear from the following detailed disclosure, as well as from the drawings.

BRIEF DESCRIPTION OF THE DRAWINGS

The above, as well as additional objects, features and advantages of the present disclosure, will be better understood through the following illustrative and non-limiting detailed description of currently preferred embodiments of the present invention, with reference to the appended drawings, where the same reference numerals will be used for similar elements.

DETAILED DESCRIPTION OF PREFERRED EMBODIMENTS

Embodiments of the present disclosure will be described in more detail in the following with reference to the accompanying drawings. All the figures are highly schematic, not necessarily to scale, and they show only parts which are necessary in order to elucidate the invention, other parts being omitted or merely suggested.

Figure 1A:
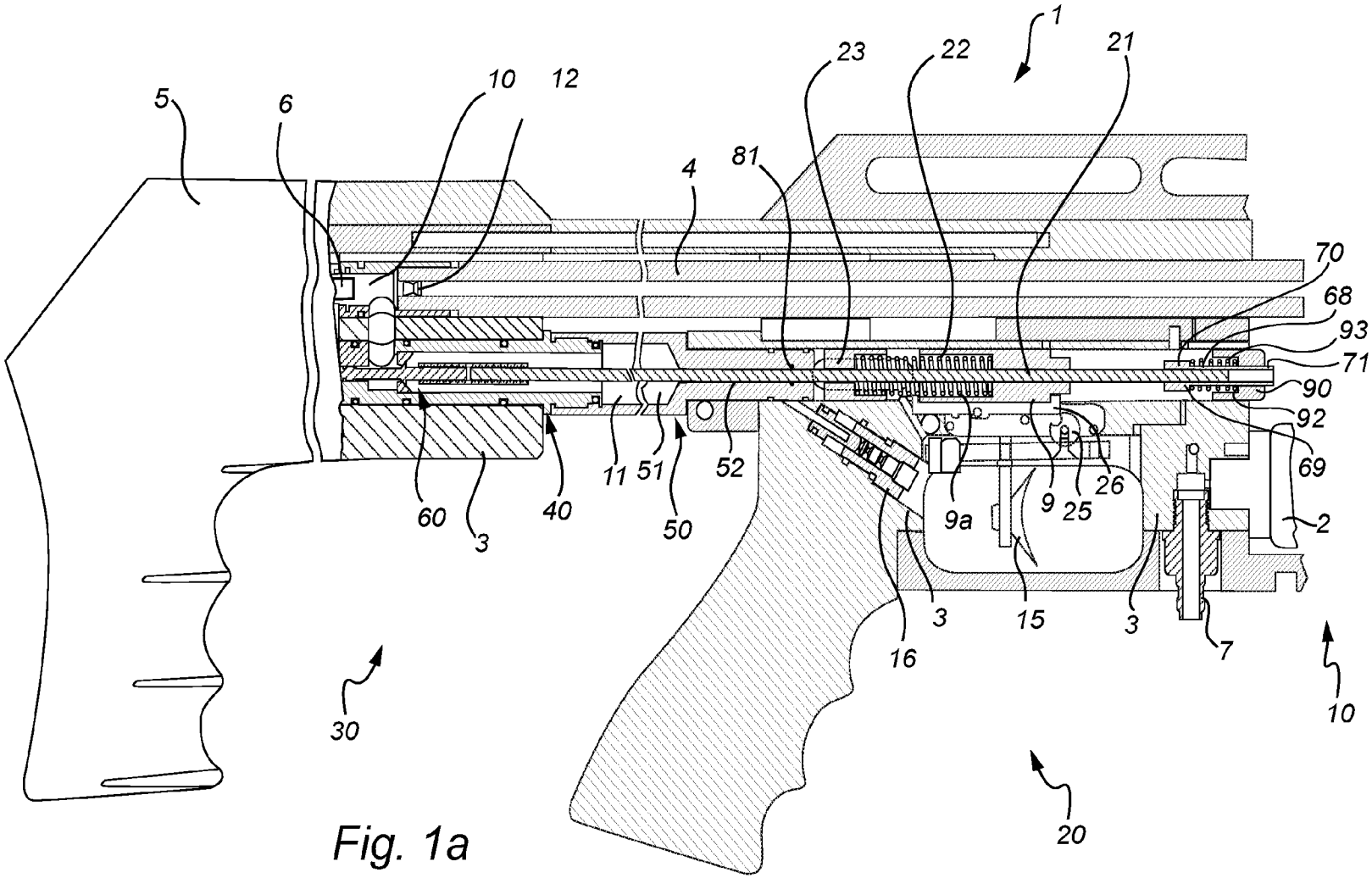
FIG. 1*a* is a cross section of a portion of an air gun according to an embodiment of the present invention, in a ready-to-fire state.
Figure 1B:
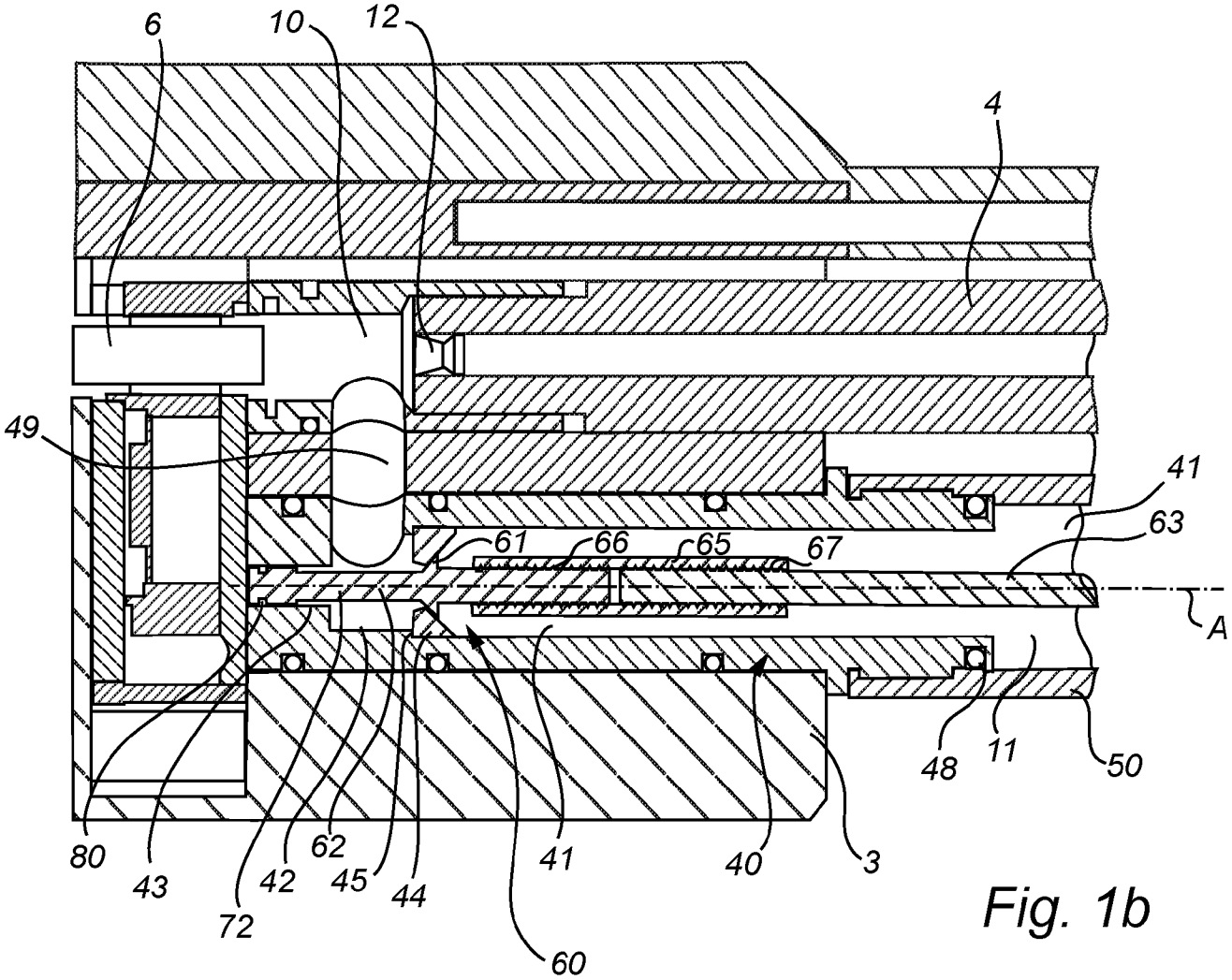
FIG. 1*b* is a more detailed cross section of the rear portion of the gun in FIG. 1*a*.
Figure 2A:
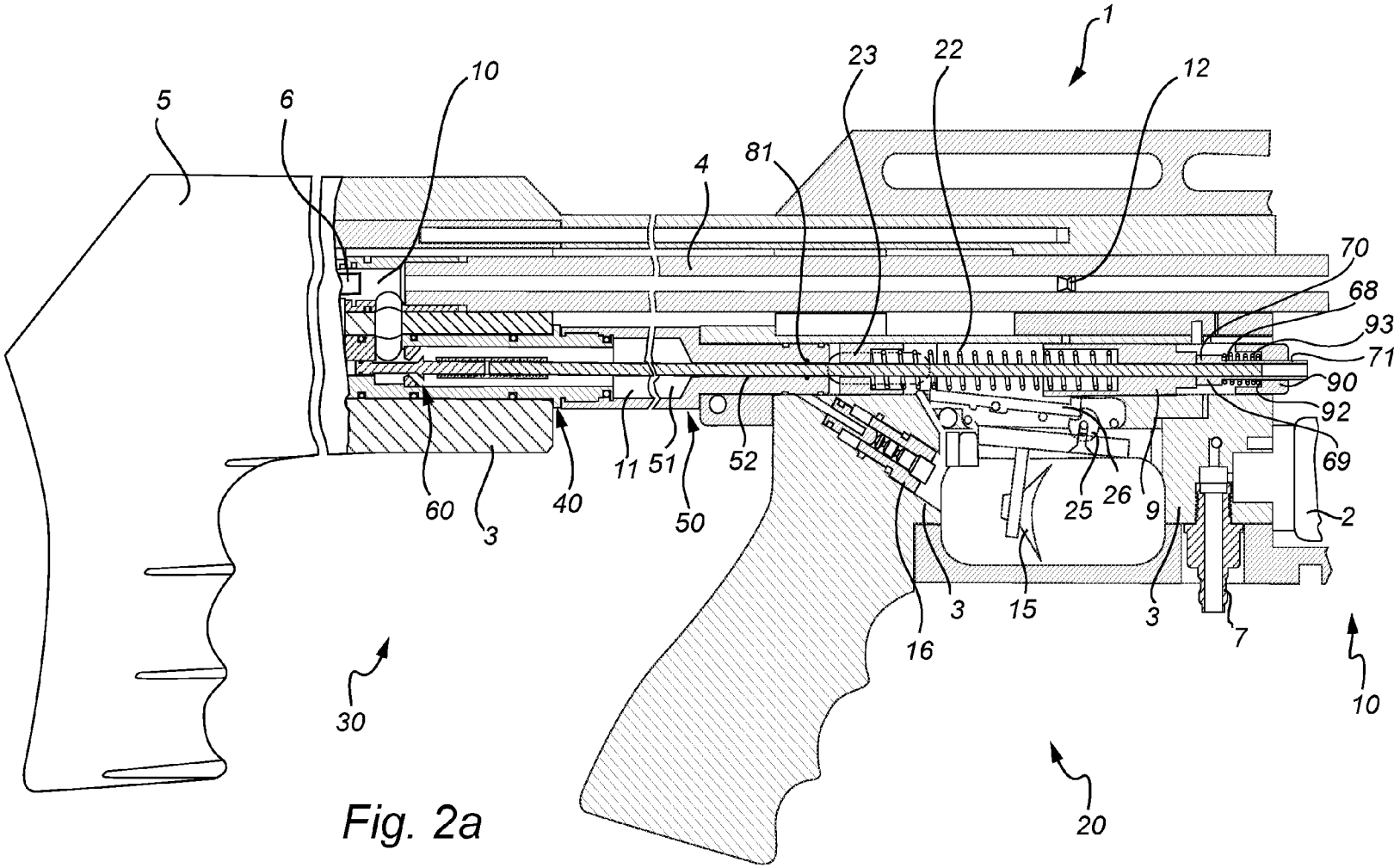
FIG. 2*a* is a cross section of the portion in FIG. 1*a*, after the trigger has been activated.
Figure 2B:
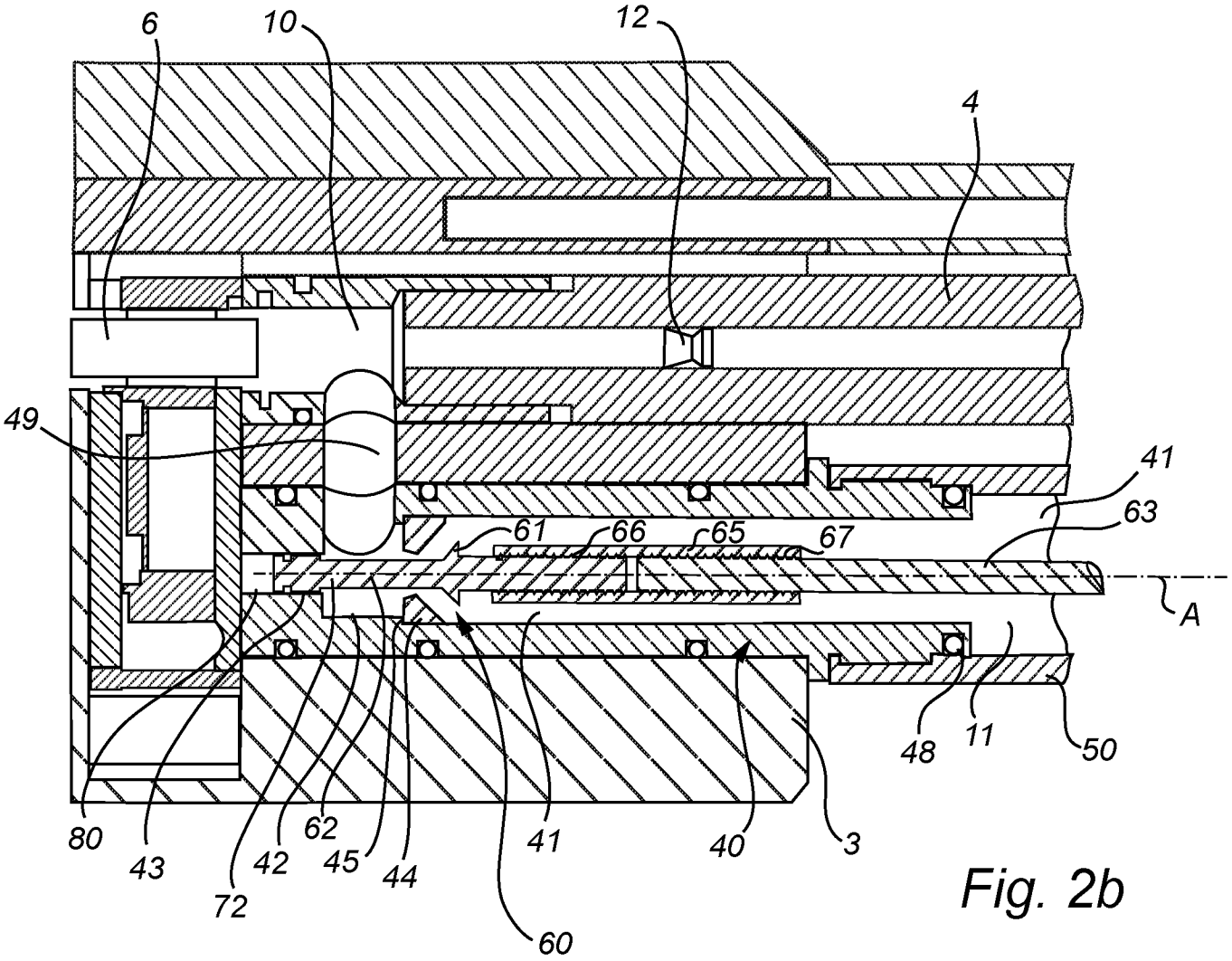
FIG. 2*b* is a more detailed cross section of the rear portion of the gun in FIG. 2*a*.

FIGS. 1*a*, 1*b*, 2*a*, 2*b* show a gas powered gun 1. FIGS. 1*a* and 1*b* show the gun in a ready-for-fire-position, while FIGS. 2*a* and 2*b* show the gun after the trigger has been activated. The same reference numerals have been used to indicate identical elements in all drawings 1*a*, 1*b*, 2*a*, 2*b*. In the following description, the expressions front and rear relate to the normal firing direction of the gun, and consequently "rear" is to the left in FIG. 1*a*, while "front" is to the right in FIG. 1*a*.

The portion of the gun 1 shown in FIGS. 1*a*, 2*a* comprises a front portion 10, where a container 2 of compressed air or other gas is fitted to the body 3 of the gun 1. A connector 7 is arranged between the bottle 2 and the gun 1 and it is used to fill the bottle 2 with gas. The gun 1 also has a rear portion 30, where a butt 5 is fitted to the body 3, and a central portion 20 between the front portion 10 and the rear portion 30. A barrel 4 is fitted in the body 3 so as to extend from the rear portion 30 through the central and front portions 20 and 10. The front end of the barrel 4 is not shown in the figures.

A feeder pin 6 is slidably arranged in the body 3 immediately behind the rear end 4*a* of the barrel 4. The feeder pin 6 is arranged to push a projectile e.g., in the form of a diabolo bullet 12, from a magazine (not shown) into the barrel 4. The feeder pin 5 is arranged to be slid back and then to be slid forward, in order push a projectile e.g., in the form of a diabolo bullet 12, from a magazine (not shown) into a firing position in the barrel 4, as shown in FIGS. 1*a* and 1*b*.

The compressed gas from the container 2 is fed to a pressure chamber 11. The pressure chamber 11 is an elongated chamber which extends from rear portion 30 towards the central portion 20 of the gun 1. The gun 1 further comprises an open-close valve 60, which is arranged in the rear end of the pressure chamber 11. In its closed state, the valve 60 seals the pressure chamber 11. In its open sate, the valve allows passage of compressed gas from the bottle 2 to a space 10 immediately behind the bullet 12 in the barrel 4.

As will be described in more detail below, the valve 60 is opened by a valve opening arrangement cooperating with a spring loaded hammer 9, which is released by a trigger 15. When the valve 60 is opened, compressed air from the chamber 11 is exhausted into the space 10 behind the bullet 12 and "fires" the bullet 12.

The gun 1 may also comprise a gas regulator 16, which also is arranged at the central portion 20 of the gun 1. A regulator is a mechanical device, i.e. a valve that controls the air pressure in the pressure chamber 11. A passage (not shown) in the gun body 3 forwards the gas from the container 2 into the regulator 16, which forwards the gas into the pressure chamber 11 and regulates the gas pressure in the pressure chamber 11. This means that the pressure is always the same and hence an airgun with a regulator shoots with very consistent velocity.

The pressure chamber 11 is here formed by a rear hollow cylinder portion 40, and a front hollow cylinder portion 50 sealingly joined together to a continuous cylindrical compartment. In the illustrated example, the rear end of the front hollow cylinder portion 50 threadedly engages the front end of the rear hollow cylinder portion 40. A sealing member 48, e.g. an o-ring, is arranged to seal between the two cylinder portions 40, 50.

With reference to FIG. 1*b*, the rear hollow cylindrical portion 40 comprises a front portion 41 in its front end, a middle portion 42 immediately behind the pressure chamber, and a rear portion 43 in its rear end. The rear portion 43 has an inner diameter which is smaller than the inner diameter of the middle and front portions 42, 41. Preferably, the inner diameter of the middle portion 42 is slightly smaller than the inner diameter of the front portion 41. The front hollow cylindrical portion 50 comprises a rear portion 51 and a front portion 52. The inner diameter of portion 51 is larger than the inner diameter of portion 52.

The front portion 41 of the rear hollow cylindrical portion 40 and the rear portion 51 of the front hollow cylindrical portion together form the pressure chamber 11. The middle portion 42 is in fluid connection with the space 10 via a channel 49 extending perpendicularly to the centre axis A of the pressure chamber 11.

With continued reference to FIG. 1*b*, the open-close valve 60 comprises a valve seat 44 arranged between the front and middle portions 41, 42 of the rear hollow cylindrical portion 40. The valve seat 44 may be arranged to abut against an annular step 45 formed by any difference in inner diameters. The valve 60 further comprises a valve head 62 which has an annular flange 61 arranged to cooperate with the valve seat 44.

The valve head 62 is here arranged in front of the valve seat 44, and is arranged at one end of a rod 63. The rod 63 forms an elongated extension of the valve head essentially in the longitudinal direction A towards the front of the gun 1 through the pressure chamber. In the illustrated example, the rod 63 and the valve head portion 62 are interconnected by means of a threaded sleeve 65. More specifically, the rod 63 and the valve head 62 each comprises threaded portions 66, 67 at the ends which shall be connected. The threaded portion 66 of the valve head 62 and the threaded portion 67 of the rod 63 are threadedly engaged to opposite ends of the sleeve 65.

The rear end 72 of the valve head 62 is received in the rear portion 43 of the rear hollow cylinder portion 40, and serves to guide the valve head 62 and the rod 63. The end 72 is further sealed against the inner walls of portion 43, here by means of an O-ring 80. At the front end of the pressure chamber 11 the rod 63 protrudes out of the pressure chamber 11 through the front portion 52 of the front cylinder portion 50. The rod 63 is sealed against the inner walls of the portion 52, here by means of an O-ring 81, in order to seal the front end of pressure chamber 11. It is noted that the diameter of the flange 61 is larger than the diameter of the rod 63 where it seals the pressure chamber 11. A pressure in the pressure chamber will therefore serve to press the valve head 62 against the valve seat 44 to effectively seal the chamber 11.

A hammer cooperating member 68 is connected to the front end of the rod 63. In the illustrated example, the rod 63 comprises at this end a threaded portion 69 which engages a threaded hole in the hammer cooperating member 68. The hammer cooperating member 68 comprises a larger diameter hammer hitting portion 70 and a smaller diameter guiding portion 71.

The guiding portion 71 is received in a support 90. The support 90 comprises a spring abutment, 92. A spring 93 is arranged between this spring abutment 92 and the hammer hitting portion 70 of the hammer cooperating member 68. The spring will serve to press the hammer cooperating member 68 and the extension member 61 in the rearwards direction, to close the valve 60 after the gun has been fired, further described below.

The hammer 9 is arranged between the pressure chamber 11 and the hammer cooperating member 68. In the illustrated example, the hammer 9 has a central though hole 21, through which the extension member 61 passes, to allow the hammer 9 to slide along the extension member 61. In its rear end 9*a*, the hammer has a compartment for receiving one end of a coil spring 22, which is arrange coaxially with the extension member 61. The other end of the coil spring 22 abuts a spring abutment, here in the form of a cylindrical cup 23. The rod 63 passes through a central through hole 24 in the cup 23, allowing relative motion between the rod 63 and the cup 23. The cup 23 is fixed with respect to the frame 3, but its position may be adjustable. A catch 25 engages the lower edge 26 of the hammer 9. The catch 25 is mechanically connected to the trigger 15. The trigger-catch cooperation can be done in many different ways and will not be explained further.

In FIGS. 1*a* and 1*b*, the gun is in a loaded position, i.e. in a ready-for-fire-position. As mentioned above, the feeder pin 6 has been slid into the barrel 4, and fed a bullet 12 into the firing position. The hammer 9 is spring loaded by the spring 22 against the catch 25, and the valve 60 seals the pressure chamber 11. The pressure chamber 11 has been filled with high pressure air from the bottle 2, with a pressure regulated by the regulator 16.

With reference to FIGS. 2*a* and 2*b*, when the hammer 9 is released by actuating the trigger 15, the hammer 9 is forced by the spring 22 into contact with the hammer cooperating member 68. By the impact, the hammer cooperating member 68 will move in the forward direction (to the right in FIG. 2*a*) and the rod 63 and the valve head 62 will move with it. The hammer 9 will thus "pull" the valve head 62 out of sealing contact with the valve seat 44 to thereby allow an exhaust of gas through the channel 49 into the space 10 behind the bullet 12. As a consequence, the bullet 12 will be discharged through the barrel 4.

When the hammer cooperating member 68 is pushed forward by the hammer 9, the spring 93 will be compressed. After impact, the spring 93 will return the hammer cooperating member 68, the rod 63 and the valve seat 62 to their original position (as in FIG. 1*a*, 1*b*), to close the valve 60.

When the bullet has been discharged, the pressure in the pressure chamber 11 will immediately drop and the regulator 16 will allow new gas to flow from the gas bottle 2 into the pressure chamber 11 to bring the pressure back to its regulated value. The pressure in the pressure chamber 11 will press the valve head 62 against the valve seat 44 to tightly seal the pressure chamber 11.

The user may now use a manual handle (not shown) to bring the hammer back against the force of the spring 22 to its ready-to-fire state, where it is again secured by the catch 25.

The person skilled in the art realizes that the present invention by no means is limited to the preferred embodiments described above. On the contrary, many modifications and variations are possible within the scope of the appended claims. For example, the exact mechanical design of the hammer and extension member is not critical, and any design allowing a relative placement of the hammer with respect to the valve according to the present invention is possible.

What is claimed is:

1. A gas powered gun for discharge of projectiles, comprising:

a barrel adapted to receive a projectile, a pressure chamber adapted to communicate with a compressed gas source, an open-close valve arranged in a rear end of said pressure chamber, and arranged, in its open state, to allow passage of gas from said pressure chamber into said barrel, to thereby discharge said projectile, said open-close valve comprising a valve seat and a valve head adapted to sealingly abut said valve seat to close said valve, said valve head being provided in one end of an elongated extension member, and a hammer arranged to cooperate with a hammer cooperating member provided at a second end of said elongated extension member, wherein said elongated extension member extends in a firing direction of said gun through said pressure chamber, and said hammer is arranged between said valve head and said hammer cooperating member, so that, when said hammer is moved in the firing direction into contact with said hammer cooperating member, said hammer cooperating member pulls said valve head out of contact with said valve seat, thereby bringing said open-close valve to its open state.

2. A gas powered gun according to claim 1, wherein said extension member is slidingly arranged through a central opening of said hammer.

3. A gas powered gun according to claim 2, further comprising a spring abutment, and a spring arranged between said spring abutment and said hammer, for spring loading said hammer, wherein said extension member is slidingly arranged through a central opening of said spring abutment and through said spring.

4. A gas powered gun according to claim 1, wherein said hammer is arranged between said pressure chamber and said hammer cooperating member.

5. A gas powered gun according to claim 1, wherein said hammer cooperating member is removably attached to said elongated extension member.

6. A gas powered gun according to claim 5, wherein said hammer cooperating portion comprises a threaded portion which is mutually matching with a threaded portion on said elongated extension member.

7. A gas powered gun according to claim 1, wherein said valve head and said extension member are connected by means of a threaded sleeve, located inside said pressure chamber.

8. A gas powered gun according to claim 1, wherein an end portion of said hammer cooperating member is guided by a support.

9. A gas powered gun according to claim 8, wherein said support comprises a spring abutment, a spring being arranged between said spring abutment and said hammer cooperating member for pushing said valve head into a closed stated after being opened.

* * * * *